US008834323B2

(12) United States Patent
Chen

(10) Patent No.: US 8,834,323 B2
(45) Date of Patent: Sep. 16, 2014

(54) FLYWHEEL DEVICE FOR AN EXERCISE BIKE

(71) Applicant: Chao-Chuan Chen, Taichung (TW)

(72) Inventor: Chao-Chuan Chen, Taichung (TW)

(73) Assignee: Zhejiang Everbright Industry, Inc., Zhejiang (CN)

( * ) Notice: Subject to any disclaimer, the term of this patent is extended or adjusted under 35 U.S.C. 154(b) by 74 days.

(21) Appl. No.: 13/760,055

(22) Filed: Feb. 6, 2013

(65) Prior Publication Data

US 2014/0221168 A1 Aug. 7, 2014

(51) Int. Cl.
*A63B 22/08* (2006.01)
*F16C 15/00* (2006.01)
*A63B 22/06* (2006.01)

(52) U.S. Cl.
CPC ..... *A63B 22/06* (2013.01)
USPC ..... 482/57; 482/63; 74/572.12

(58) Field of Classification Search
USPC ..... 482/57–65
See application file for complete search history.

(56) References Cited

U.S. PATENT DOCUMENTS

| | | | | | |
|---|---|---|---|---|---|
| 4,028,962 | A * | 6/1977 | Nelson | 74/572.12 |
| 4,358,105 | A * | 11/1982 | Sweeney, Jr. | 482/5 |
| 4,602,781 | A * | 7/1986 | La Marsh et al. | 482/58 |
| 4,705,493 | A * | 11/1987 | Lin | 474/69 |
| 4,809,970 | A * | 3/1989 | Beistegui | 482/64 |
| 4,860,611 | A * | 8/1989 | Flanagan et al. | 74/572.12 |
| 5,067,710 | A * | 11/1991 | Watterson et al. | 482/3 |
| 5,191,809 | A * | 3/1993 | Craig | 482/64 |
| 5,247,853 | A * | 9/1993 | Dalebout | 74/574.2 |
| 6,475,122 | B2 * | 11/2002 | Wu | 482/57 |
| 7,481,749 | B1 * | 1/2009 | Chen | 482/64 |
| 7,833,129 | B2 * | 11/2010 | Badarneh et al. | 482/5 |
| 2006/0128533 | A1 * | 6/2006 | Ma et al. | 482/63 |

* cited by examiner

*Primary Examiner* — Stephen Crow

(57) ABSTRACT

A flywheel device for an exercise bike includes a frame body, a pedal unit and a reinforced glass flywheel. The pedal unit and the reinforced glass flywheel are assembled to the frame body. The frame body has a driving member connected with the pedal unit and the reinforced glass flywheel. The pedal unit and the reinforced glass flywheel are rotated spontaneously via the driving member. A driven device is pivotally mounted on a center portion of the reinforced glass flywheel. Two ends of the driven device are positioned on the frame body. One end of the driven device assembled with the driving member.

7 Claims, 4 Drawing Sheets

FLYWHEEL DEVICE FOR AN EXERCISE BIKE

BACKGROUND OF THE INVENTION

1. Field of the Invention

The present invention relates to an exercise bike, and more particularly to a flywheel device for an exercise bike.

2. Description of Related Art

Indoor exercises are prevailing nowadays. The indoor exercises are not affected by bad weather conditions unlike that of outdoor exercises. Various types of exercise apparatuses for indoor exercises are developed so as to provide different exercising purposes. Exercise bike is the most popular exercise apparatus as exercise bike can be operated easily and allows user to obtain adequate exercise in a relatively short time.

A conventional flywheel device for an exercise bike comprises a frame body, a flywheel and an outer frame. The outer frame is disposed around the flywheel for preventing foreign substances from contacting with the flywheel. The shape of the cross-section of the outer frame is circular or rectangular. The outer frame is formed as an annular frame corresponding to the shape of the flywheel. The outer frame is mounted on the frame body as a protecting device.

The conventional flywheel device for an exercise bike is made of metal materials such as iron or aluminum. However, the conventional flywheel device for an exercise bike has some disadvantages as following.

1. The conventional metallic flywheel is rusted easily which causes the exercise bike cannot be operated.

2. The conventional flywheel device for an exercise bike is too heavy, so that moving the conventional flywheel device for an exercise bike is inconvenient for a user.

3. The conventional metallic flywheel is too heavy, so that the user need to stamp the exercise bike at the initial time too forcefully and the user will harm their knees easily.

The present invention has arisen to obviate/mitigate the disadvantages of the conventional exercise bike.

SUMMARY OF THE INVENTION

The main objective of the present invention is to provide a driving device for exercise bike.

To achieve the objective, a flywheel device for an exercise bike comprises a frame body, a pedal unit and a reinforced glass flywheel, the pedal unit and the reinforced glass flywheel assembled to the frame body, the frame body having a driving member connected with the pedal unit and the reinforced glass flywheel, the pedal unit and the reinforced glass flywheel rotated simultaneously via the driving member, a driven device rotatably mounted on a center portion of the reinforced glass flywheel, two ends of the driven device positioned on the frame body, one end of the driven device assembled with the driving member. Wherein the driven device has a driven disc and a shaft rod; the driven disc has a first disc portion, a second disc portion and a neck portion; the neck portion connects with the first disc portion and the second disc portion; the reinforced glass flywheel has a through hole defined at the center portion therethrough; the driven disc is inserted into the through hole, and then the reinforced glass flywheel is positioned on the neck portion; a through opening opened through the first disc portion, the second disc portion and the neck portion; the shaft rod passes through the through opening and two ends of the shaft rod are exposed out of two sides of the driven disc respectively; at least one bearing and at least one fixing element sleeve onto the two ends of the shaft rod respectively; the fixing element is abutted against an inner periphery of the through opening of the driven disc; each bearing is positioned between each end of the shaft rod and each fixing element; each bearing is abutted against each fixing element; the frame body has two supporting bases corresponding to the shaft rod; the two supporting bases are opposite to each other; each supporting base has a retaining groove defined therein; the two ends of the shaft rod are assembled on the two retaining grooves of the two supporting bases rotatably; an outer frame is defined around the reinforced glass flywheel; a distance is defined between the outer frame and the reinforced glass flywheel; at least one end of the outer frame is assembled on the frame body; the outer frame is disposed around the outer periphery of the reinforced glass flywheel; the supporting frame has at least one fixing member defined thereon; the outer frame is fixed to the supporting frame via the fixing member; the diameter of the reinforced glass flywheel is defined between 200-500 mm; the thickness of the reinforced glass flywheel is defined between 3-25 mm.

The present invention will become more obvious from the following description when taken in connection with the accompanying drawings which show, for purposes of illustration only, a preferred embodiment in accordance with the present invention.

DETAILED DESCRIPTION OF THE INVENTION

Figure 1:
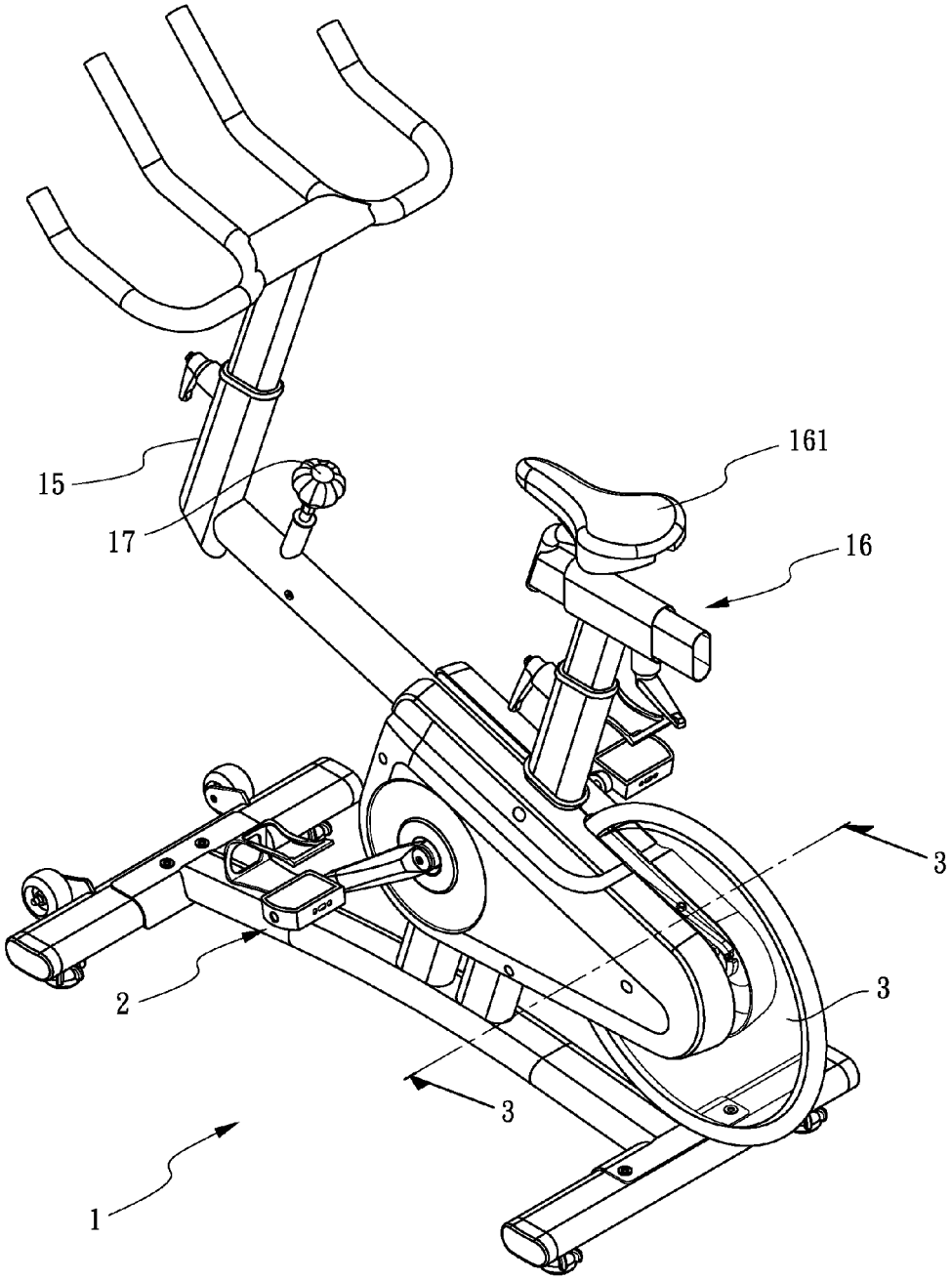
FIG. 1 is a perspective view of a flywheel device for an exercise bike of the present invention.
Figure 2:
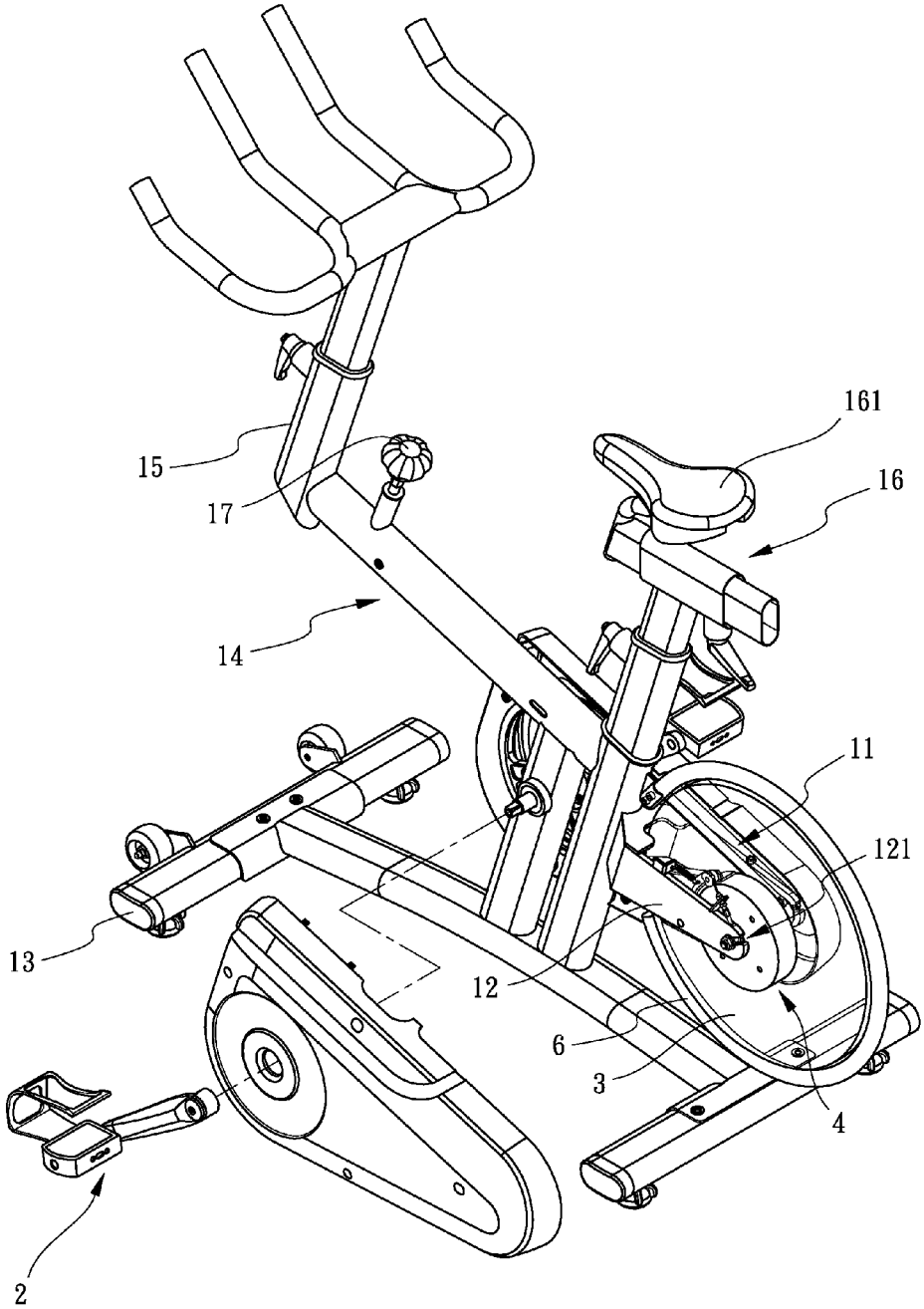
FIG. 2 is an exploded perspective view for showing a pedal unit is detached from the flywheel device for an exercise bike of the present invention.

Referring to FIGS. 1-2, a flywheel device for an exercise bike in accordance with the present invention comprises a frame body 1, a pedal unit 2 and a reinforced glass flywheel 3.

The pedal unit 2 and the reinforced glass flywheel 3 are assembled to the frame body 1. The frame body 1 has a driving member 11 connected with the pedal unit 2 and the reinforced glass flywheel 3. The pedal unit 2 and the reinforced glass flywheel 3 are rotated simultaneously via the driving member 11. A driven device 4 is rotatably mounted on a center portion of the reinforced glass flywheel 3. Two ends of the driven device 4 are positioned on the frame body 1. One end of the driven device 4 is assembled with the driving member 11.

Figure 3:
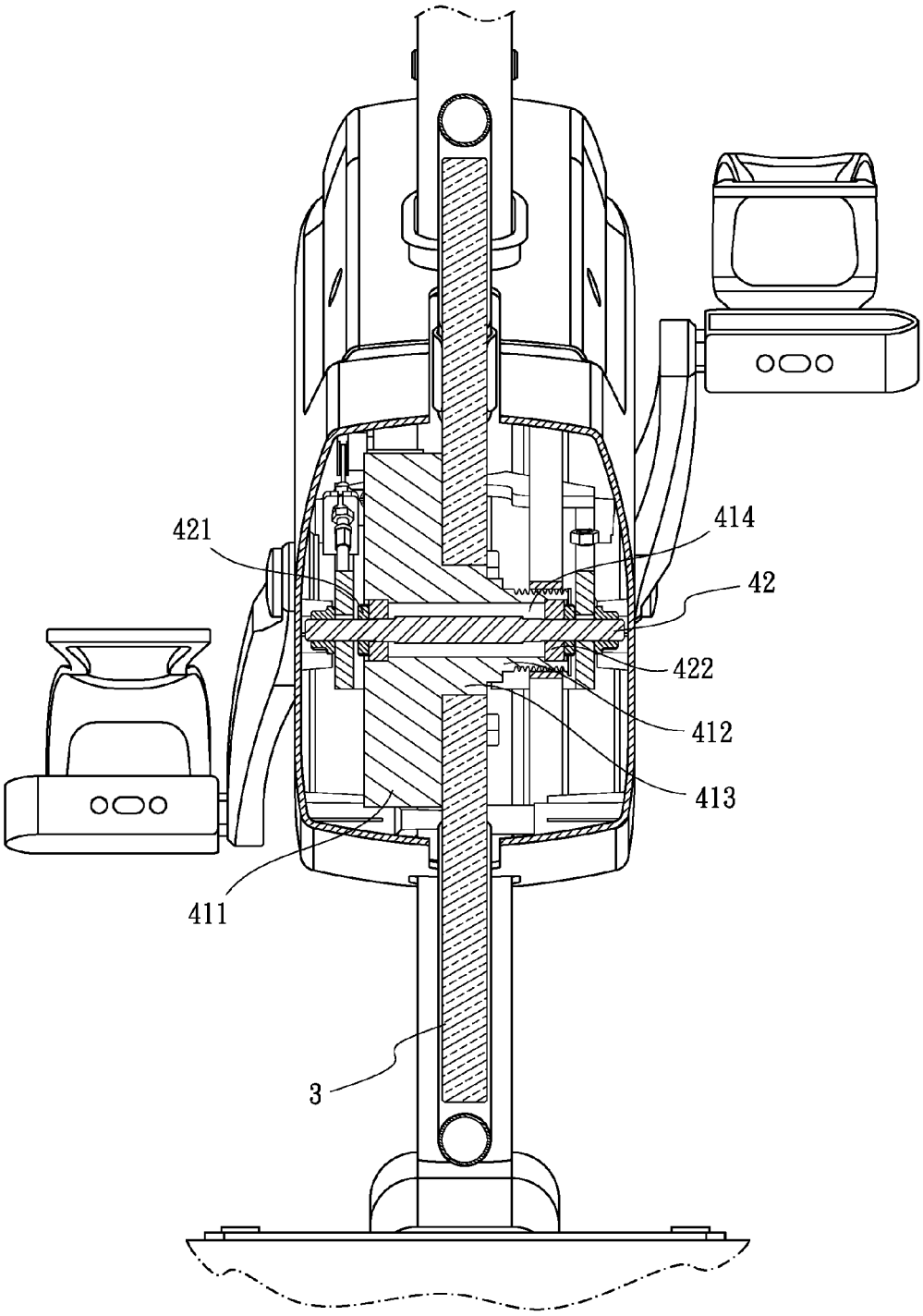
FIG. 3 is a cross-sectional view alone line 3-3 of FIG. 1.

Referring to FIG. 3, in order to position the reinforced glass flywheel 3 on the frame body 1 rotatably, the driven device 4 further has a driven disc 41 and a shaft rod 42. The driven disc 41 has a first disc portion 411, a second disc portion 412 and a neck portion 413. The neck portion 413 connects with the first disc portion 411 and the second disc portion 412. The driven disc 41 is gradually descended from the first disc portion 411 to the second disc portion 412 and is formed as a stair shape. The diameter of the first disc portion 411 is larger than the diameters of the neck portion 413 and the second disc portion 412. The diameter of the neck portion 413 is further larger than a diameter of the second disc portion 412.

Figure 4:
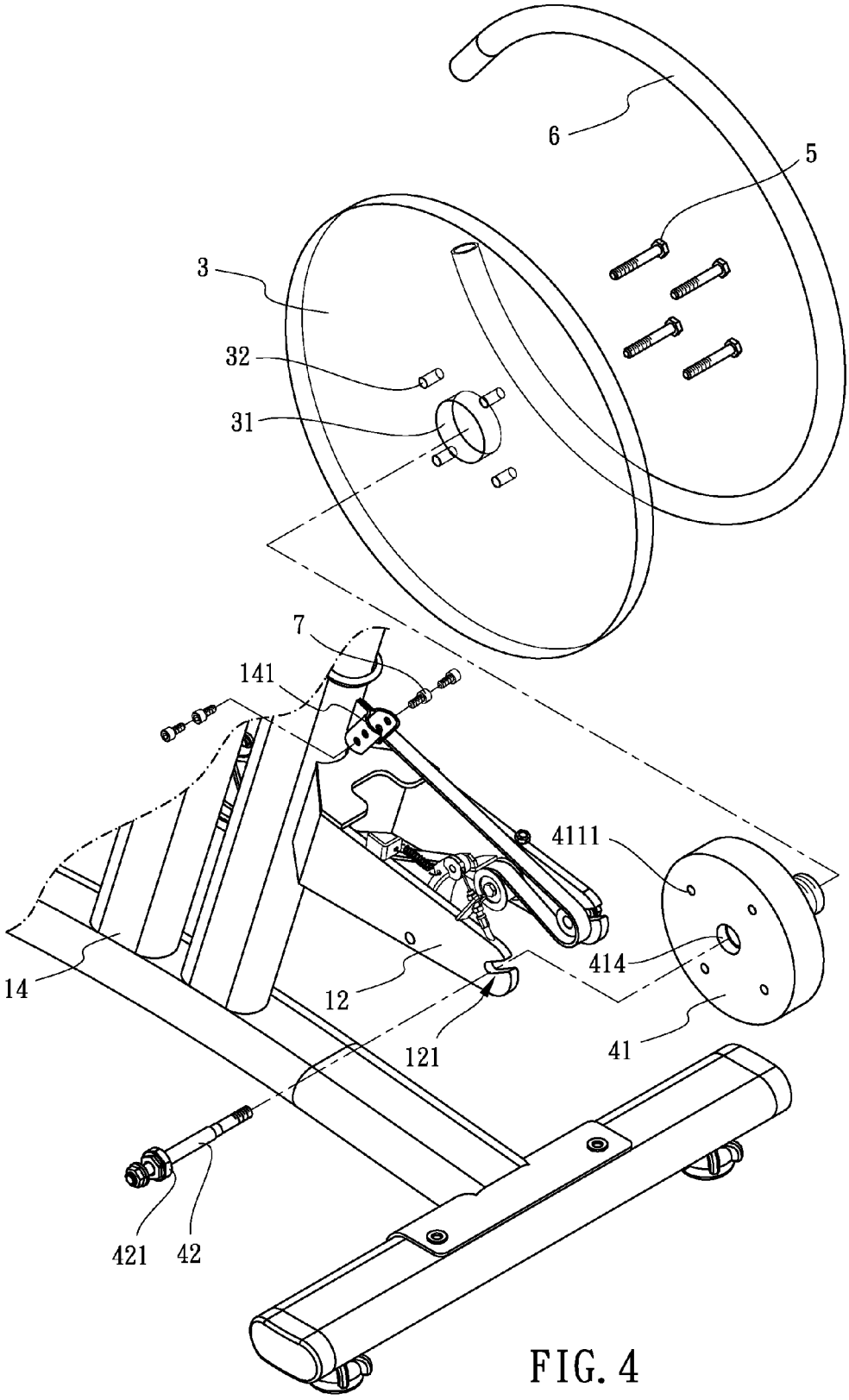
FIG. 4 is another exploded perspective view for showing that a reinforced glass flywheel, an outer frame and a driven device are detached from the flywheel device for an exercise bike of the present invention.

Referring to FIG. 4, the reinforced glass flywheel 3 has a through hole 31 defined at the center portion therethrough. A plurality of threaded holes 32 is defined around the through hole 31. The first disc portion 411 of the driven disc 41 has a plurality of sub threaded holes 4111 corresponding to the threaded holes 32. The number of the threaded holes 32 equals to the number of the sub threaded holes 4111. Under this arrangement, the second disc portion 412 of the driven disc 41 is inserted into the through hole 31; and then, the reinforced glass flywheel 3 is positioned on the neck portion 413; eventually, a plurality of screw members 5 are threaded into the threaded holes 32 of the reinforced glass flywheel 3 and the sub threaded holes 4111 of the first disc portion 411, so that the reinforced glass flywheel 3 and the driven disc 41 are locked together.

The driven disc 41 has a through opening 414 opened through the first disc portion 411, the second disc portion 412 and the neck portion 413. The shaft rod 42 passes through the through opening 414. Two ends of the shaft rod 42 are exposed out of two sides of the driven disc 41 respectively. The two ends of the shaft rod 42 are assembled on the frame body 1 rotatably, so that the reinforced glass flywheel 3 is rotatably assembled on the frame body 1.

Referring to FIG. 3, at least one bearing 422 and at least one fixing element 421 sleeve onto the two ends of the shaft rod 42 respectively. An outer periphery of the bearing 422 is abutted against an inner periphery of the through opening 414 of the driven disc 41 so as to prevent the shaft rod 42 from being lost as the reinforced glass flywheel 3 is rotated. Each fixing element 421 is positioned between each end of the shaft rod 42 and each bearing 422. Each fixing element 421 is abutted against each bearing 422 tightly. The bearing 422 is used for rotating the shaft rod 42 smoothly, so that the reinforced glass flywheel 3 is rotate smoothly. (The number of the bearing 422 is not limited in the present invention.)

Referring to FIG. 2 and FIG. 4, the frame body 1 has two supporting bases 12 corresponding to the shaft rod 42. The two supporting bases 12 are opposite to each other. Each supporting base 12 has a retaining groove 121 defined therein. The two ends of the shaft rod 42 are assembled on the two retaining grooves 121 of the two supporting bases 12 rotatably. The shaft rod 42 is fixed on the two retaining grooves 121 by means of screws.

Referring to *Figs*.1-2, the reinforced glass flywheel 3 is mounted on the rear side of the frame body 1. The framed body 1 has a stationary base 13. The stationary base 13 is I-shaped. A supporting frame 14 is mounted on the stationary base 13 upright. The supporting frame 14 has a handle adjusting assembly 15 defined at one end thereof The supporting frame 14 has a seat adjusting assembly 16 defined at another end thereof. The supporting base 12, the pedal unit 2 and the driving member 11 are assembled to the supporting frame 14 so as to drive the reinforced glass flywheel 3 to rotate. The supporting frame 14 has a brake control member 17 assembled between the handle adjusting assembly 15 and the seat adjusting assembly 16. The brake control member 17 adjusts a rotating speed of the reinforced glass flywheel 3, as known in the art and will not be discussed further. The seat adjusting assembly 16 has a seat 161 assembled on a top end of thereof.

In order to protect the reinforced glass flywheel 3 from being broken because of the impaction of foreign substances, an outer frame 6 is defined around the reinforced glass flywheel 3. The outer frame 6 is formed as a long strip with a circular cross-section. One end of the outer frame 6 is assembled on the supporting frame 14 of the frame body 1. The supporting frame 14 has a fixing member 141 defined thereon. The fixing member 141 is C-shaped. The fixing member 141 has a plurality of screws 7 screwed into two outer sides of the fixing member 141. The outer frame 6 is fixed to the fixing member 141 via the screws 7. A distance is defined between the outer frame 6 and the reinforced glass flywheel 3 so as to prevent the reinforced glass flywheel 3 from being interfered with the outer frame 6. The outer frame 6 is disposed around the outer periphery of the reinforced glass flywheel 3. (The shape of the outer frame 6 is not limited in the present invention.)

The detail descriptions and advantages of the reinforced glass flywheel 3 of the present invention are shown as following.

1. Specifications of the reinforced glass flywheel 3: The diameter of the reinforced glass flywheel 3 is defined between 200-500 mm; the thickness of the reinforced glass flywheel 3 is defined between 3-25 mm. The reinforced glass flywheel 3 has some advantages such as light weight and anti-rust, so that a user does not need to stamp the exercise bike at the initial time too forcefully so as to protect knees from harming.

2. High flexural and impact strength: The flexural strength of the reinforced glass flywheel 3 is three to five times greater than the flexural strength of one flywheel made of normal glass. The impact strength of the reinforced glass flywheel 3 is five to ten times greater than the impact strength of said flywheel.

3. Operation security: When the reinforced glass flywheel 3 is broken, the reinforce glass crumbles into small granular chunks instead of splintering into jagged shards so as to prevent a user from hurting.

4. Compressive stress: The surface compressive stress of the reinforced glass flywheel 3 is 95-110 MPa.

5. Thermal shock resistance: The thermal shock resistance of the reinforced glass flywheel 3 is raised to twice to three times as greater as the thermal shock resistance of the normal glass flywheel. The reinforced glass flywheel 3 could bear the difference in temperature which is higher than 150 Celsius degrees so as to prevent the reinforced glass flywheel 3 from thermal cracking.

All in all, the reinforced glass flywheel 3 of the present invention decreases the whole weight of the exercise bike and prevents the flywheel from being rusted. In addition, the reinforced glass flywheel 3 of the present invention also decreases the cost of manufacture.

Although the invention has been explained in relations to its preferred embodiment, it is to be understood that many other possible modifications and variations can be made without departing from the spirit and scope of the invention as hereinafter claimed.

What is claimed is:

1. A flywheel device for an exercise bike comprising:

a frame body, a pedal unit and a reinforced glass flywheel;

the pedal unit and the reinforced glass flywheel assembled to the frame body;

the frame body having a driving member connected with the pedal unit and the reinforced glass flywheel, the pedal unit and the reinforced glass flywheel rotated simultaneously via the driving member; and a driven device rotatably mounted on a center portion of the reinforced glass flywheel, two ends of the driven device positioned on the frame body, one end of the driven device assembled with the driving member;

wherein the driven device has a driven disc and a shaft rod; the driven disc has a first disc portion, a second disc portion and a neck portion; the neck portion connects with the first disc portion and the second disc portion; the reinforced glass flywheel has a through hole defined at the center portion therethrough; the driven disc is inserted into the through hole, and then the reinforced glass flywheel is positioned on the neck portion; a through opening opened through the first disc portion, the second disc portion and the neck portion; the shaft rod passes through the through opening and two ends of the shaft rod are exposed out of two sides of the driven disc respectively.

2. The flywheel device for an exercise bike as claimed in claim 1, wherein at least one bearing and at least one fixing element sleeve onto the two ends of the shaft rod respectively; the fixing element is abutted against an inner periphery of the through opening of the driven disc; each bearing is positioned between each end of the shaft rod and each fixing element; each bearing is abutted against each fixing element.

3. The flywheel device for an exercise bike as claimed in claim 1, wherein the frame body has two supporting bases corresponding to the shaft rod; the two supporting bases are opposite to each other; each supporting base has a retaining groove defined therein; the two ends of the shaft rod are assembled on the two retaining grooves of the two supporting bases rotatably.

4. The flywheel device for an exercise bike as claimed in claim 1, wherein an outer frame is defined around the reinforced glass flywheel; a distance is defined between the outer frame and the reinforced glass flywheel; at least one end of the outer frame is assembled on the frame body; the outer frame is disposed around the outer periphery of the reinforced glass flywheel.

5. The flywheel device for an exercise bike as claimed in claim 4, wherein the supporting frame has at least one fixing member defined thereon; the outer frame is fixed to the supporting frame via the fixing member.

6. The flywheel device for an exercise bike as claimed in claim 1, wherein the diameter of the reinforced glass flywheel is defined between 200-500 mm.

7. The flywheel device for an exercise bike as claimed in claim 1, wherein the thickness of the reinforced glass flywheel is defined between 3-25 mm.

* * * * *